US005990399A

United States Patent [19]

Runyon

[11] Patent Number: 5,990,399

[45] Date of Patent: Nov. 23, 1999

[54] SAXOPHONE PALM KEY AND METHOD OF USE

[76] Inventor: Clinton A. Runyon, 174 Emerite Dr., Lafayette, La. 70506

[21] Appl. No.: 09/129,615

[22] Filed: Aug. 5, 1998

[51] Int. Cl.[6] ..... G10D 7/08

[52] U.S. Cl. ..... 84/385 R

[58] Field of Search ..... 84/380 R, 385 R

[56] References Cited

U.S. PATENT DOCUMENTS 2,555,980 6/1951 Loney ..... 84/385 R
2,710,558 6/1955 Lefevre-Selmer ..... 84/385 R
3,857,317 12/1974 Carree .
4,148,242 4/1979 Woehr et al. .
4,250,791 2/1981 tairadate .

*Primary Examiner*—Stanley J. Witkowski
*Attorney, Agent, or Firm*—Robert N. Montgomery

[57] ABSTRACT

A removable key attachment has been developed which when adjustably attached to the low C-sharp spatula of a saxophone, having an articulated C-sharp, enables the player to depress the low C-sharp lever with the heal of the left hand. Thereby, leaving the little finger of the left hand free to press the low B or B-flat key without sliding from key to key, producing a much smother passage with much greater speed.

8 Claims, 3 Drawing Sheets

SAXOPHONE PALM KEY AND METHOD OF USE

BACKGROUND OF THE INVENTION

1. Field of the Invention

This invention relates generally to musical wind instrument keys and more particularly to a key attachment for saxophones having an articulated C-sharp key.

2. General Background

In conventional saxophones, the keys for playing the notes G#, C#, B, and B flat form a cluster played by the fingers of the left hand. More specifically, the B and B flat notes are played by alternately pressing the respective keys with the little finger of the left hand. When playing musical arrangements requiring a transition between C#, B and B flat, the little finger must slide rapidly and smoothly between these adjacent keys; otherwise an improper sound results.

This transition is particularly difficult for novices and, with some selections, for accomplished saxophonist. It is also impossible to hold the C# lever and the B lever keys both down at the same time, thus limiting the musical arrangement possibilities. As a result of this difficulty many low register combination notes are simply avoided all together.

This problem has been partially addressed by Woehr et al in U.S. Pat. No. 4,148,242. Woehr discloses a new saxophone key located adjacent the thumb rest, operated by the thumb of the left hand to play the B flat note thus avoiding the need to make the difficult transition of the little finger. However, such a key does nothing to enhance the C# to B flat transition. The Woehr key also requires extensive modification to the instrument and extensive retraining.

Others have recognized the importance of making a smooth transition from C# to B flat and have addressed this issue by providing rollers and guides such as is disclosed by Tairadate in U.S. Pat. No. 4,250,791 and Carree in U.S. Pat. No. 3,857,317.

SUMMARY OF THE INVENTION

A removable key attachment has been developed which when adjustably attached to the low C# spatula of a saxophone having an articulated C#, enables the player to depress the low C# lever with the heal of the left hand. Thereby, leaving the little finger of the left hand free to press the low B key without sliding from key to key, producing a much smother passage with much greater speed. The key attachment referred to herein as a palm key allows the C# and low B key to be depressed at the same time. The palm key attachment further allows the low C#.[12] B and B flat pads to close together which is otherwise impossible.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
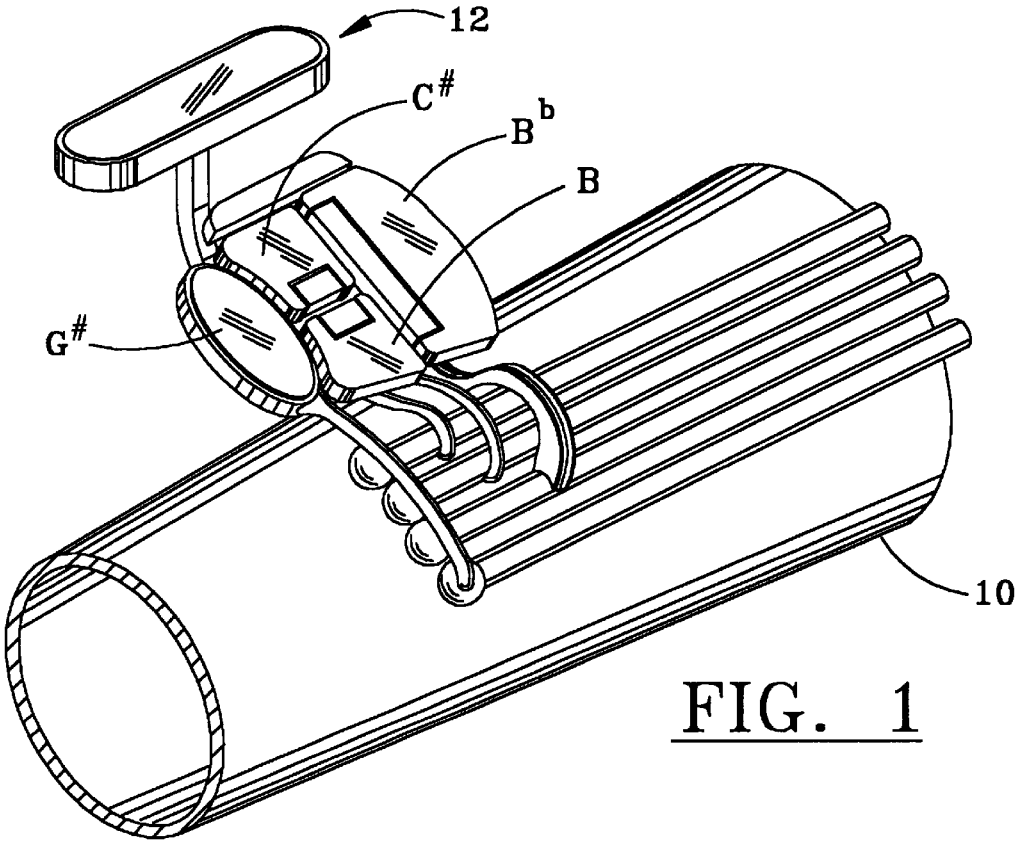
FIG. 1 is a partial isometric top view illustrating the preferred embodiment as attached to a saxophone.
Figure 2:
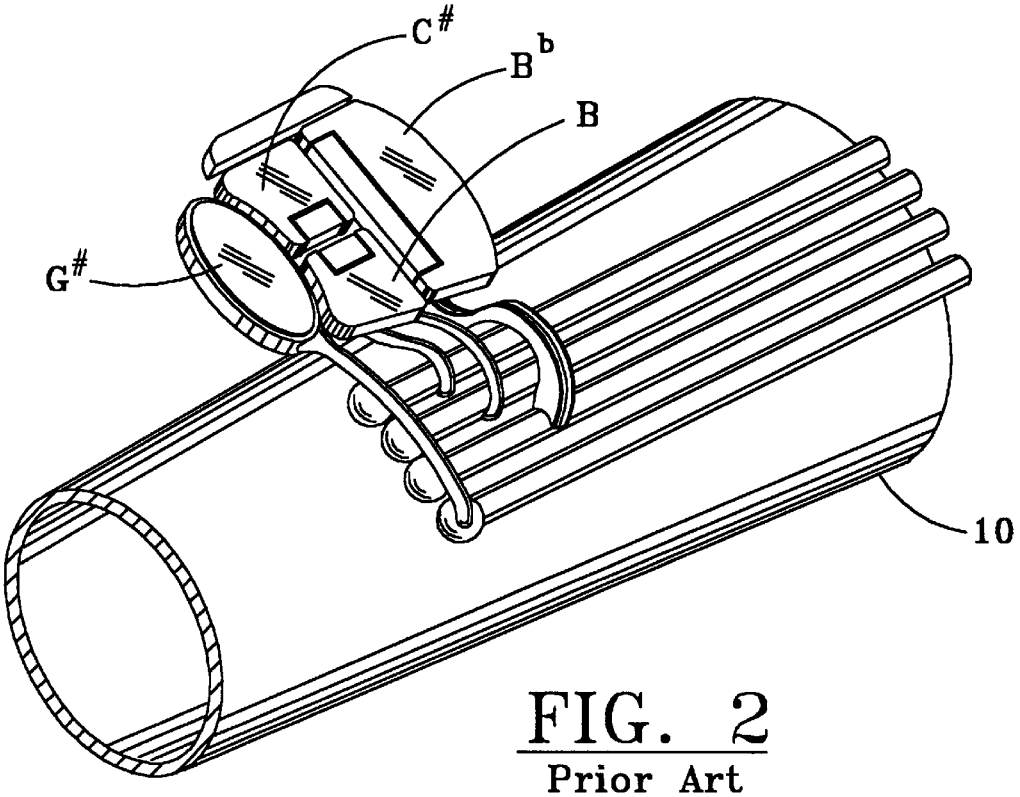
FIG. 2 Prior Art
FIG. 2 is a partial isometric top view illustrating the prior art.
Figure 3:
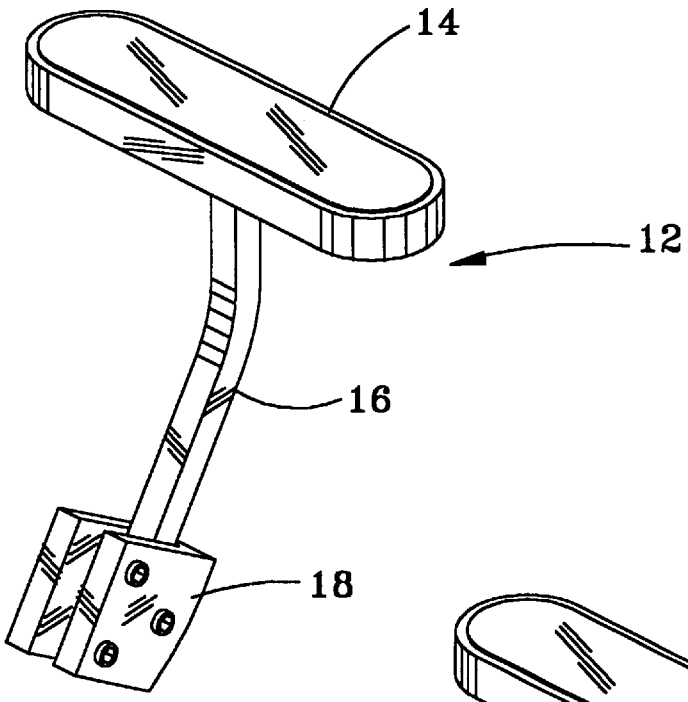
FIG. 3 is an isometric view of the preferred embodiment.
Figure 4:
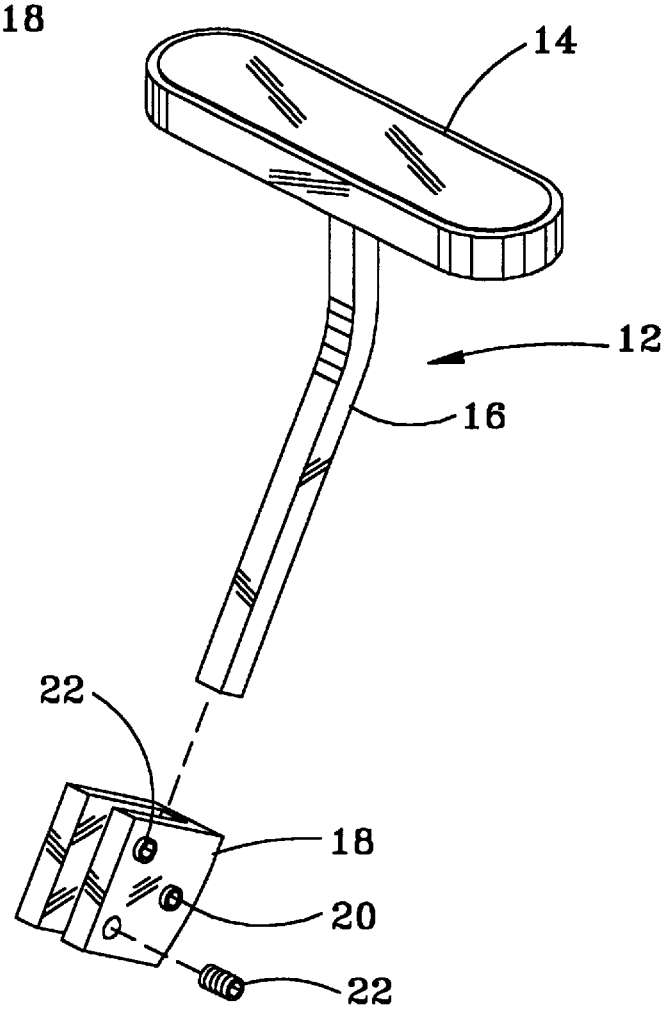
FIG. 4 is an isometric exploded assembly view of the preferred embodiment.
Figure 5:
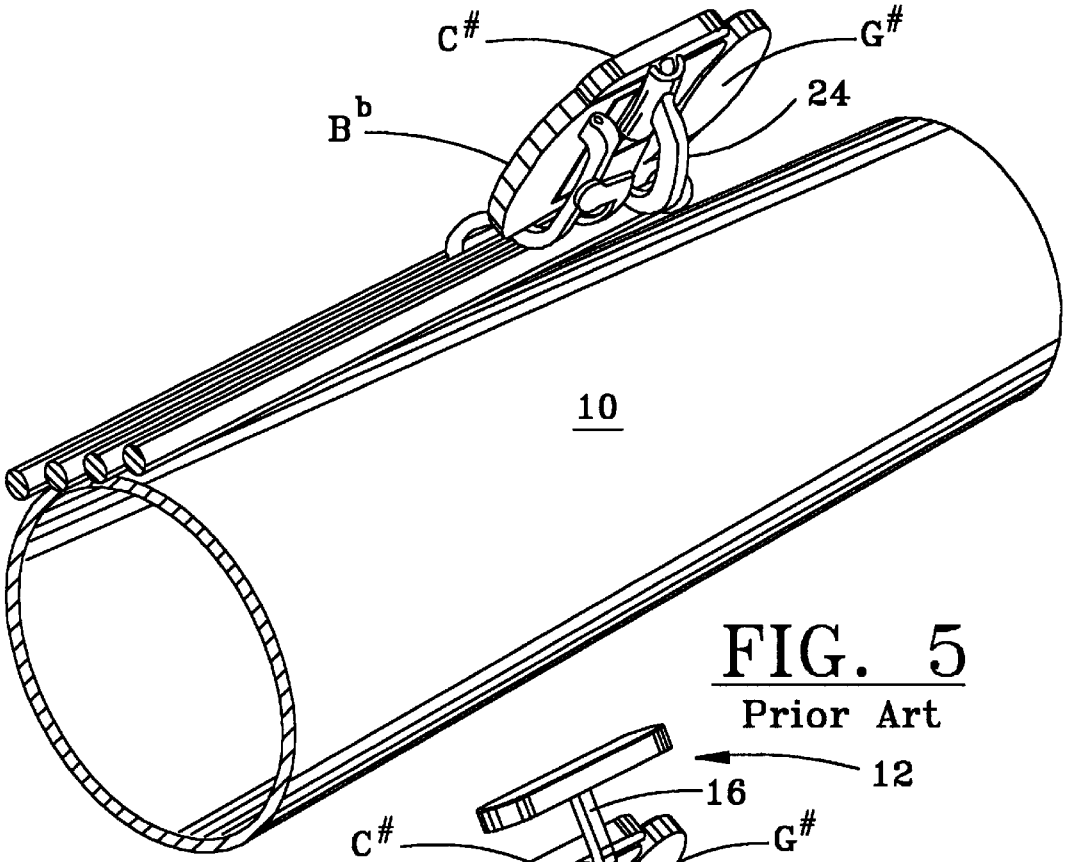
FIG. 5 Prior Art
FIG. 5 is an isometric lower view of the prior art.
Figure 6:
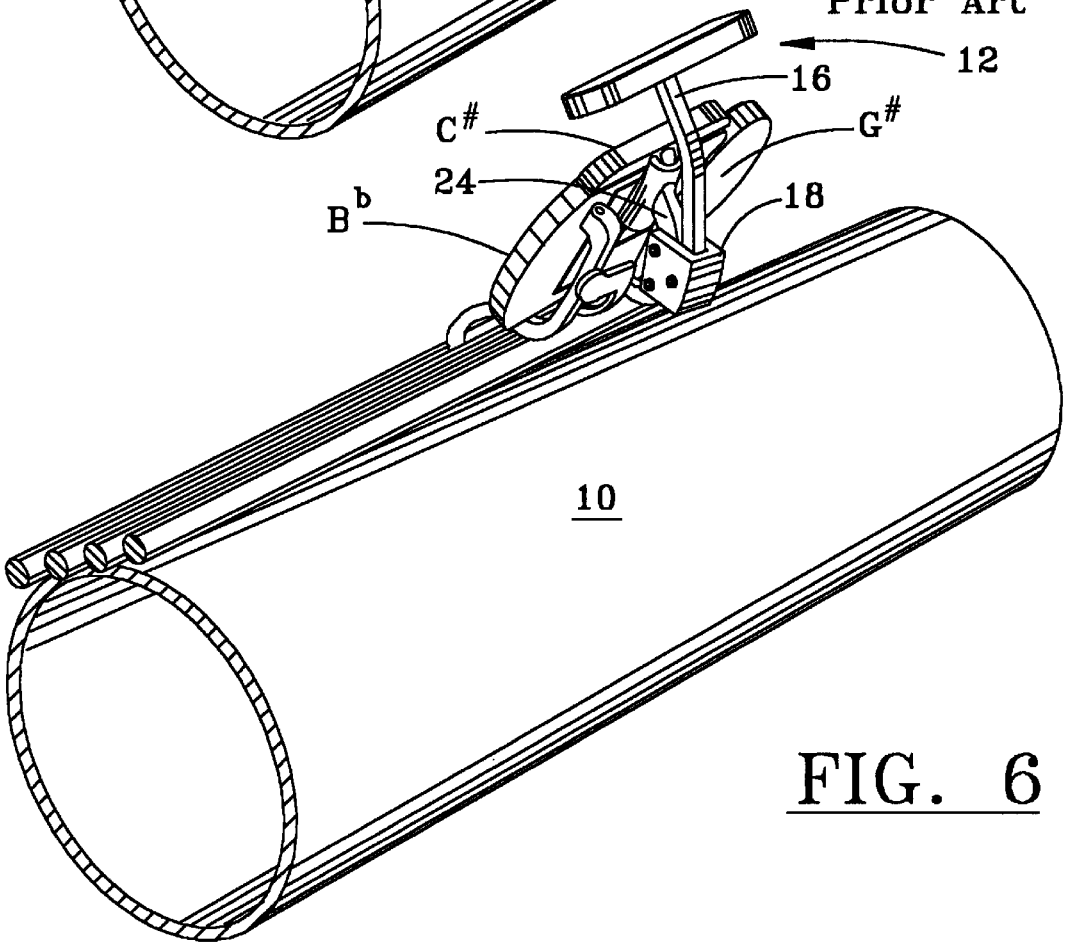
FIG. 6 is an isometric lower view of the preferred embodiment installed.

A conventional saxophone 10 having a key cluster including the G#, articulated C#, B, and B flat keys as illustrated in FIG. 2 forms the basis for the instant invention. As seen in FIG. 1 a fifth key 12 is added to this cluster. These keys are all played by the fingers of the left hand and primarily by the little finger of the left hand. The fifth or palm key 12 as seen in FIG. 3 includes an elongated key portion 14 and a bent stem portion 16 attached to the under side of the key portion 14. A connecting block 18 shown removed in FIG. 4 is also provided which is slidably adjustable along the stem portion 16 and secured to the bent stem portion 16 by a set screw 20. The particular curvature of the stem 16 depends on the brand of saxophone to which it is adapted. The connecting block 18 is adjustably attached to the C# key lever 24 as seen in FIG. 5 and 6 and secured to the C# key lever 24 by set screws 22. The angle of incidence between the connecting block 18 and the C# lever 24 is also adjustable. These adjustments allow the palm key portion 14 to be positioned so that the heal of the left hand fits comfortable on the palm key portion 14 without interfering with the movements of the little finger of the left hand or any other key. In operation the palm key 12 enables the player to depress the low C# key spatula with the hell of the left hand adjacent to the little or pinkie finger, thus leaving the pinkie finger free to depress the low B natural key. Therefore enabling the player to move his little finger from low C# to low B without sliding, thus producing a much smother passage with greater speed. It should be noted that while holding the low C# key down with the palm key 12, simultaneously pressing of the low B key is now possible. It is also possible to hold the palm key 12 down and simultaneous press the low B lever, thereby closing the low C#, B and B flat pads together, which heretofore was impossible.

The palm key attachment 12 enhances the player's ability to play complicated compositions heretofore unachievable by saxophones. For example it is now possible to trill C#-B or C# to B flat by wiggling the low B or low B flat key while depressing the palm key 12. Continuing to hold the palm key 12 down allows the player to move up the scale automatically playing the G#(A-flat) combination. The player may also play up and down the F#, B D-flat, etc. scales as well as triads and $7^{th}$'s thus making anything with numerous sharp's and flat's less difficult to master.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. A palm actuated key for attachment to the low C sharp key of a saxophone comprising:

a) an elongated key spatula portion having upper and lower side;

b) a stem portion attached Der perpendicular to said lower side of said key spatula portion; and c) a connector means slidable along length of said stem portion for attaching said palm key to said low C-sharp key.

2. The palm actuated key attachment according to claim 1 wherein said connector is attached to said low C-sharp key and further comprises a means for adjustably attaching said stem portion to said C-sharp key lever.

3. The palm actuated key attachment according to claim 2 wherein said connector is a slotted block having at least one set screw located perpendicular to said slot for adjustably attaching said stem portion to said low C-sharp key.

4. A palm actuated key for adjustable attachment to the C-sharp key of a saxophone comprising:

a) an elongated key portion having upper and lower side;

b) a curved stem portion attached perpendicular to said lower side; and c) a means for attaching said curved stem portion to the C-sharp key lever of a saxophone in a manner wherein said key portion is oriented adjacent to said C-sharp key and parallel with length of said saxophone and said stem portion does not contact or operate any adjacent keys.

5. The palm actuated key attachment according to claim 4 wherein said means for attaching is adjustable along the length of said stem portion and said C-sharp key lever.

6. A method of operating the C-sharp key of a saxophone with the heel and palm of the player's left hand comprising the steps of:

a) providing an adjustable palm actuated key attachment for the low C-sharp key of a saxophone comprising:

i) an elongated key portion having under and lower side;

ii) a stem portion attached perpendicular to said lower side of said key portion; and iii) a connector having means for being adjustably attached to said C-sharp key along length of said stem portion; and b) securing said palm key attachment to said C-sharp key in a manner whereby said attachment is parallel to and located immediately adjacent said C-sharp key, and does not interfere with the function of said C-sharp key or any adjacent keys when operated by the palm of a players left hand.

7. The method according to claim 6 further comprising the step of operating said C-sharp key with said attachment with the heel of a player's left hand and simultaneously depress keys located adjacent said C-sharp key independently with the player's little finger.

8. The method according to claim 6 further comprising the step of operating said C-sharp key with palm of said player's left hand while rapidly depressing adjacent G-sharp, B and B flat keys independently with the player's little finger.

* * * * *